US005588922A

United States Patent [19]

Schmidt et al.

[11] Patent Number: 5,588,922

[45] **Date of Patent: *Dec. 31, 1996**

[54] IRON GOLF CLUB HEAD WITH FORWARDLY DIVERGENT INTERIOR RECESS

[75] Inventors: Glenn H. Schmidt, Malibu; Richard C. Helmstetter, Carlsbad, both of Calif.

[73] Assignee: Callaway Golf Company, Carlsbad, Calif.

[ * ] Notice: The term of this patent shall not extend beyond the expiration date of Pat. No. 5,282,625.

[21] Appl. No.: 354,486

[22] Filed: Dec. 12, 1994

Related U.S. Application Data

[63] Continuation of Ser. No. 235,930, May 2, 1994, which is a continuation of Ser. No. 52,697, Apr. 30, 1993, Pat. No. 5,330,187, which is a continuation of Ser. No. 921,857, Aug. 5, 1992, Pat. No. 5,282,625.

[51] Int. Cl.[6] ..... B29C 43/18

[52] U.S. Cl. ..... 473/324; 473/329; 473/332

[58] Field of Search ..... 273/167 H, 169, 273/170, 171, 172, 167 F, 167 J; 473/340, 329, 332, 341, 347, 348, 349, 350, 334, 324

[56] References Cited

U.S. PATENT DOCUMENTS

| | | | |
|---|---|---|---|
| D. 248,181 | 6/1978 | Cervantes | 473/324 |
| D. 303,132 | 8/1989 | Muta | 473/324 |
| D. 321,920 | 11/1991 | Parente et al. | 473/324 |
| 1,854,548 | 4/1932 | Hunt | 473/324 |
| 2,781,197 | 2/1957 | Wiley | 473/324 |
| 2,846,228 | 8/1958 | Reach | 473/324 |
| 3,079,157 | 2/1963 | Turner | 473/324 |
| 3,134,596 | 5/1964 | Boznos | 473/324 |
| 3,749,408 | 7/1973 | Mills | 473/324 |
| 3,814,437 | 6/1974 | Winquist | 473/324 |
| 3,841,641 | 10/1974 | Bennett | 473/324 |
| 3,847,399 | 11/1974 | Raymont | 473/324 |
| 3,923,308 | 12/1975 | Mills | 473/324 |
| 3,967,826 | 7/1976 | Judice | 473/324 |
| 3,970,236 | 7/1976 | Rogers | 473/324 |
| 4,027,885 | 6/1977 | Rogers | 473/324 |
| 4,043,562 | 8/1977 | Shillington | 473/324 |
| 4,113,249 | 9/1978 | Beery | 473/324 |
| 4,121,832 | 10/1978 | Ebbing | 473/324 |
| 4,199,144 | 4/1980 | Skelly | 473/324 |
| 4,252,262 | 2/1981 | Igarashi | 473/324 |
| 4,398,965 | 8/1983 | Campau | 473/324 |
| 4,573,685 | 3/1986 | Young, IV et al. | 473/324 |
| 4,632,400 | 12/1986 | Boone | 473/324 |
| 4,635,756 | 3/1987 | Sato | 473/324 |
| 4,715,601 | 12/1987 | Lamanna | 473/324 |
| 4,740,345 | 4/1988 | Nagasaki et al. | 264/257 |
| 4,792,139 | 12/1988 | Nagasaki et al. | 473/324 |
| 4,798,383 | 1/1989 | Nagasaki et al. | 473/324 |
| 4,811,950 | 3/1989 | Kobayashi | 473/324 |
| 4,848,747 | 7/1989 | Fujimura et al. . | |

(List continued on next page.)

FOREIGN PATENT DOCUMENTS

| | | | |
|---|---|---|---|
| 608128 | 1/1994 | European Pat. Off. | 473/324 |
| 582366 | 6/1994 | European Pat. Off. . | |
| 371974 | 3/1932 | United Kingdom . | |
| 1534471 | 12/1978 | United Kingdom . | |
| 2165461 | 4/1986 | United Kingdom | 473/324 |

OTHER PUBLICATIONS

Golf Digest Annual 1978, Feb., 1978, p. 22, "Reflex".

*Primary Examiner*—V. Millin
*Assistant Examiner*—Charles W. Anderson
*Attorney, Agent, or Firm*—William W. Haefliger

[57] ABSTRACT

A golf club head having a heel, toe, upper flange, lower flange, and a front wall defining an upwardly and rearwardly inclined front face comprising a head defining a forwardly extending main recess located rearwardly of the front wall, and between the upper and lower flanges; the upper flange having a lower surface exposed to the recess; the lower flange having an upper surface exposed to the recess; the lower and upper surfaces relatively diverging, forwardly, and toward reduced thickness portions of the flanges proximate the front wall.

23 Claims, 2 Drawing Sheets

U.S. PATENT DOCUMENTS

| | | | |
|---|---|---|---|
| 4,854,581 | 8/1989 | Long | 473/324 |
| 4,884,812 | 12/1989 | Nagasaki et al. | 473/324 |
| 4,913,435 | 4/1990 | Kobayashi | 473/324 |
| 4,928,972 | 5/1990 | Nakanishi et al. | 473/324 |
| 4,957,294 | 9/1990 | Long | 473/324 |
| 4,964,640 | 10/1990 | Nakanishi et al. . | |
| 4,995,609 | 2/1991 | Parente et al. | 473/324 |
| 5,016,882 | 5/1991 | Fujimura et al. | 473/324 |
| 5,026,056 | 6/1991 | McNally et al. | 473/324 |
| 5,046,733 | 9/1991 | Antonious | 473/324 |
| 5,067,711 | 11/1991 | Parente et al. | 473/324 |
| 5,078,398 | 1/1992 | Reed et al. | 473/324 |
| 5,127,653 | 7/1992 | Nelson | 473/324 |
| 5,176,384 | 1/1993 | Sata et al. | 473/324 |
| 5,282,625 | 2/1994 | Schmidt et al. | 273/167 H |
| 5,290,036 | 3/1994 | Fenton et al. | 473/324 |
| 5,301,946 | 4/1994 | Schmidt et al. | 273/169 |

FIG. 1.
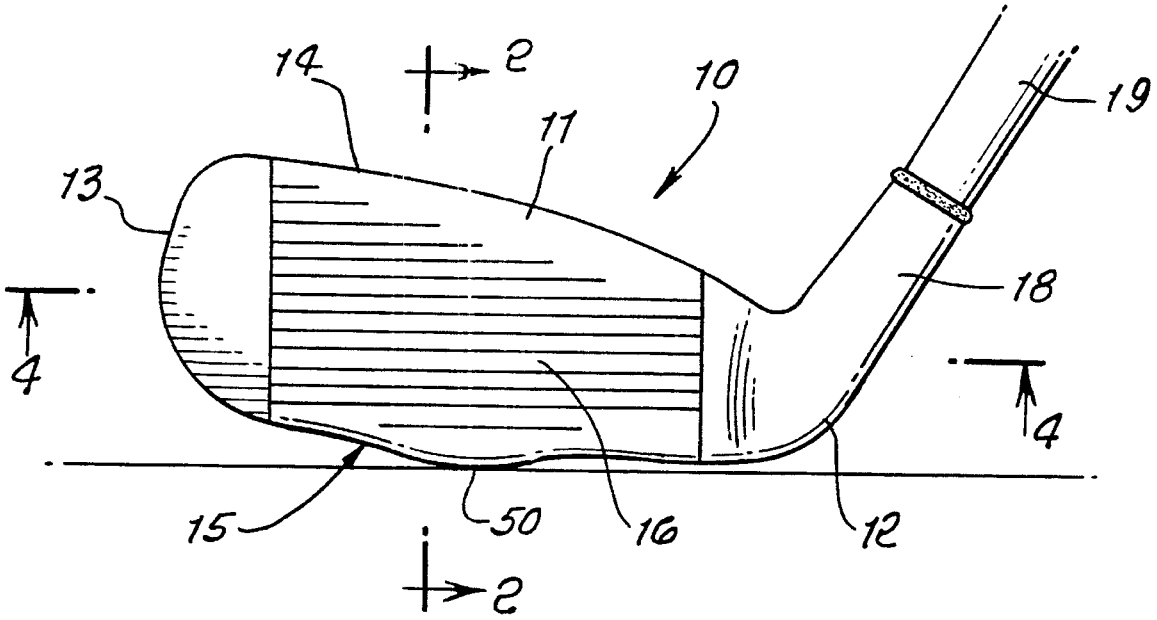
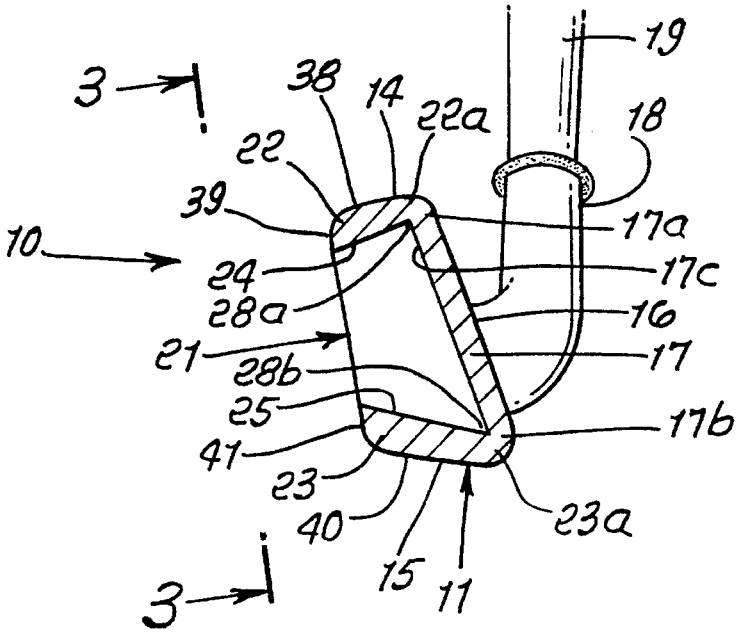
FIG. 2.

IRON GOLF CLUB HEAD WITH FORWARDLY DIVERGENT INTERIOR RECESS

This application is a continuation-in-part of Ser. No. 08/235,930 filed May 2, 1994; which is a continuation-in-part of Ser. No. 08/052,697 filed Apr. 30, 1993, now U.S. Pat. No. 5,330,187 issued Jul. 19, 1994; which is a continuation-in-part of Ser. No. 921,857 filed Aug. 5, 1992, now U.S. Pat. No. 5,282,625 issued Feb. 1, 1994.

BACKGROUND OF THE INVENTION

This invention relates generally to golf clubs, and more particularly to golf club irons of improved construction to achieve advantages, such as twist resistance, during impact with golf balls, and the provision of a very large sweet spot. In this regard, and in the past, irons evolved in design from flat back to hollow back structure, the present invention providing a further evolution in back structure to achieve advantages, as referred to, and including casting and fabrication advantages.

There is continuing need for improvements in golf club iron heads that will realize twist resistance and enlarged sweet spot characteristics, as well as facilitation of head casting. In this regard, U.S. Pat. Nos. 5,301,946 and 5,282,625 are related to the present invention, and they disclose the provision of undercut recesses in iron heads.

There is need for an improved head configuration which will realize the advantages of such undercutting, while eliminating difficulty in achieving or fabricating such undercutting.

SUMMARY OF THE INVENTION

It is a major object of the invention to provide an improved iron head construction meeting the above needs. Basically, the invention is embodied in a head metallic body, configured to define one or more flanges directed rearwardly from peripheral extent of the head front wall, the flange or flanges tapering toward that front wall. For example, the head may include a body having a front wall and upper and lower flanges, a) the head defining a forwardly extending main recess located rearwardly of the front wall, and between the upper and lower flanges, b) the upper flange having a lower surface exposed to the recess, c) the lower flange having an upper surface exposed to the recess, d) the lower and upper surfaces relatively diverging, forwardly, and toward reduced thickness portions of the flanges proximate the front wall.

Another objective is to provide a virtual undercut, which extends in a loop that lies generally parallel to the inclined front face of the iron. The inclination of that loop varies with the number of the iron, designating different front face inclinations, as for example 1 to 9 irons and wedges.

Yet another object is to provide a set of irons, each iron incorporating a forwardly diverging main recess, and upper and lower rearward projections extending generally horizontally irrespective of the angles of the front faces of the irons in the set.

As will be seen, the reduced thickness portions of the flanges typically define upper and lower webs adjacent the rear side of the head front wall, and at the upper and lower peripheries of that wall.

In addition, the upper flange may have minimum thickness at the upper web, and may have thickness that increases rearwardly of that web; and the lower flange may have minimum thickness at the lower web, and may have thickness that increases rearwardly of that web. A similar, tapered flange, or web, may be provided at the head toe, and so as to arcuately merge with upper and lower tapered flanges, as referred to.

Accordingly, the present invention allows an undercut recess or recesses, and the main recess, as disclosed in the above referenced related patents, to merge in such a way as to maintain advantages in twist resistance and enlarged sweet spot formation, as well as to facilitate ease in casting the head, particularly adjacent the minimum thickness webs.

These and other objects and advantages of the invention, as well as the details of an illustrative embodiment, will be more fully understood from the following specification and drawings, in which:

DRAWING DESCRIPTION

FIG. 1 is a front elevation of a golf club iron incorporating the invention;

FIG. 2 is a vertical section taken on lines 2—2 of FIG. 1;

DETAILED DESCRIPTION

Figure 3:
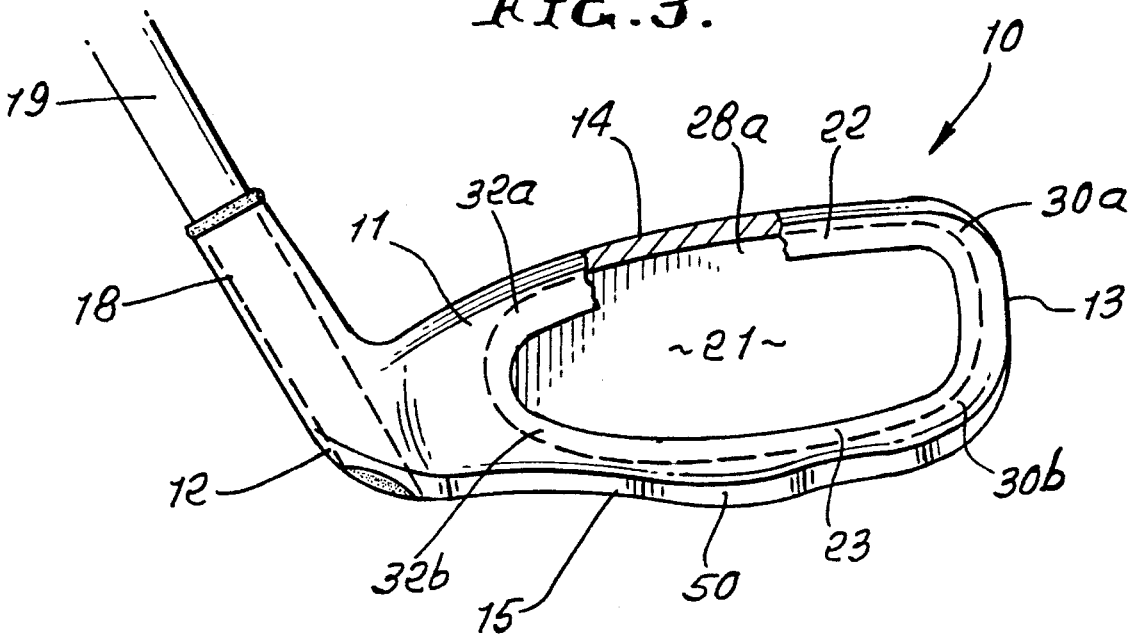
FIG. 3 is a rear elevational view of the FIG. 1 head, taken on lines 3—3 of FIG. 2.

In the drawings, a golf club iron head 10, in the form of a #3 iron of a set, has a body 11 defining a heel 12, toe 13, top wall 14, and sole 15. The body also defines an upwardly and rearwardly inclined front face 16 at the frontal side of an associated front wall 17. A hosel is shown at 18 and integrally joins the body; and a shaft 19 extends into and through the hosel as shown, and is anchored therein in a suitable manner. The head and hosel may consist of a one-piece, metallic, steel casting, other metals and alloys being usable.

In accordance with the invention, the head body 11 defines a forwardly extending main recess 21 located rearwardly of the front wall 17, and between upper and lower projections or flanges 22 and 23. The latter are integral with the front wall 17 at its uppermost and lowermost extents 17*a* and 17*b*. The upper flange 22 has a lower surface 24 that extends rearwardly and downwardly, in ball address position of the head, as seen in FIG. 2. The lower flange 23 has an upper surface 25 that extends rearwardly and upwardly in FIG. 2. Surfaces 24 and 25 are exposed to the main recess, and they relatively diverge, forwardly and toward reduced thickness portions 22*a* and 23*a* of the flanges, proximate the head front wall. At the juncture of the head front wall rear surface 17*c*, and the flange surfaces 24 and 25, portions of undercut recesses are effectively formed, as at 28*a* and 28*b*. Such undercut recesses are preferably continued at 28*c* and 28*d*, as seen in FIG. 4.

Figure 4:
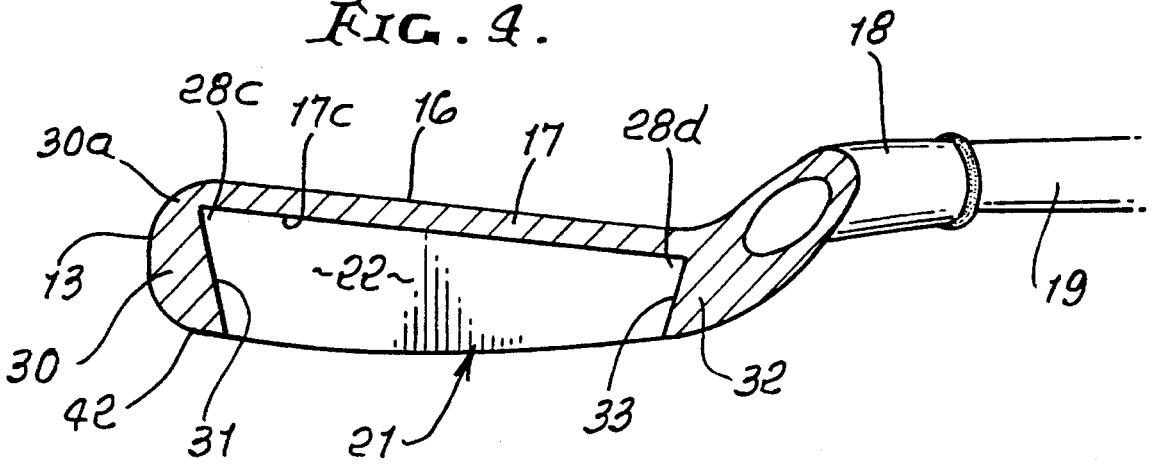
FIG. 4 is a horizontal section taken on lines 4—4 of FIG. 1.

FIGS. 3 and 4 also show a third rearwardly projecting flange 30 integral with the upper and lower flanges at the toe end at the head, and arcuately merging therewith, as at 30*1* and 30*b*, and undercut recess 28*c* is formed adjacent the rear surface 17*c* and the inner surface 31 of flange 30. Likewise, a fourth rearwardly projecting flange or body portion 32 is integral with the upper and lower flanges closer to the heel end of the head than flanges 22, 23 and 30. Flange 32 arcuately merges with flanges 22 and 23 at 32*a* and 32*b*; and undercut recess 28*d* is formed adjacent the front wall rear surface 17*c* and the inner surface 33 of flange 32. Recesses 28*a*–28*d* form a loop, as is clear from FIG. 3; and they extend or project outwardly toward the head top wall 14, the head bottom wall or sole 15, the toe region 35, and the region 32 near the heel.

As seen in FIG. 4, flange 30 and 32 inner surfaces 31 and 33 relatively diverge in a forward direction, and they extend into proximity to rear surface 17*c* of the head front wall.

The reduced or minimum thickness portions 22*a* and 22*b* of the two flanges 22 and 23 define upper and lower webs, each such web typically having thickness between 0.070 and 0.170 inch. Likewise, the minimum thickness web 30*a* of toe end flange 30 has thickness between 0.070 and 0.170. Such webs are located immediately rearwardly of peripheral extents of the head front wall.

Typically, the looping effectively undercut recess portions 28*a* and 28*b* are elongated directionally between the toe and heel, over the major length of the head, thereby achieving a large portion of the benefits of the invention. These benefits include metal redistribution toward the upper and lower peripheries of the head, and projecting rearwardly at 22 and 23, and also at 30 and 32, for enhancing anti-twist of the head during stroking and ball impact. Such metal rearward redistribution also facilitates provision of a larger sweet spot associated with the ball striking front face of front wall 17. Further, the head configuration makes casting of the head easier than casting the head of U.S. Pat. No. 5,282,625. The toe end and head end flange configurations, as disclosed, contribute further to these benefits or advantages.

Additional features and characteristics of the flange configurations are as follows: each flange 22, 23 and 30 has minimum thickness at its associated web; the upper flange 22 has an upper surface 38 and thickness between surface 38 and its lower surface 24, which thickness increases substantially uniformly in a rearward direction toward and to the flange rearward face 39; and the lower flange 23 has a lower surface 40 and thickness between surface 40 and its upper surfaces 25, which thickness substantially uniformly increases in a rearward direction toward and to the flange rear face 41. In this regard, the thickness of toe end flange 30 also increases uniformly from its associated web 30*a* to the rearwardmost face 42 of flange 30.

Also, each flange has rearward length that is substantially greater than the flange thickness between flange upper and lower surfaces.

Finally, the sole 15 is provided with a shallow medial ridge 50 projecting arcuately downwardly, as seen in FIGS. 1 and 3. That ridge extends rearwardly, as shown, on the bottom flange 23, and contributes to ball control upon impact of the head with a golf ball.

We claim:

1. A golf club head having a heel, toe, upper flange, lower flange, and a front wall defining an upwardly and rearwardly inclined front face comprising a) the head defining a forwardly extending main recess located rearwardly of said front wall, and between said upper and lower flanges, b) said upper flange having a lower surface exposed to said recess, c) said lower flange having an upper surface exposed to said recess, d) said lower and upper surfaces relatively diverging, forwardly, from generally their rearwardmost extents and toward reduced thickness portions of said flanges proximate said front wall.

2. The combination of claim 1 wherein said reduced thickness portions of said flanges define upper and lower webs.

3. The combination of claim 2 wherein said upper flange has minimum thickness at said upper web between 0.070 and 0.170 inches.

4. The combination of claim 2 wherein said lower flange has minimum thickness at said lower web between 0.070 and 0.170 inches.

5. The combination of claim 3 wherein said lower flange has minimum thickness at said lower web.

6. The combination of claim 3 wherein said upper web is located adjacent the uppermost extent of said front wall.

7. The combination of claim 6 wherein said lower web is located adjacent the lowermost extent of said front wall.

8. The combination of claim 1 wherein said upper flange has an upper surface, and thickness between said upper flange upper surface and lower surface, said thickness increasing in a rearward direction.

9. The combination of claim 8 wherein the upper flange has rearward length along said upper surface thereof that is substantially greater than the upper flange maximum thickness between said upper and lower surfaces thereof.

10. The combination of claim 8 wherein said lower flange has a lower surface and thickness between said lower flange lower surface and upper surface, said thickness increasing in a rearward direction.

11. The combination of claim 8 wherein said upper flange thickness increases substantially uniformly in said rearward direction, from a location proximate said front wall to the rearwardmost extent of said upper flange.

12. The combination of claim 11 wherein said lower flange thickness increases substantially uniformly in said rearward direction, from a location proximate said front wall to the rearwardmost extent of said lower flange.

13. The combination of claim 11 wherein said upper flange at said location proximate said front wall defines an upper web.

14. The combination of claim 1 wherein said lower flange has a lower surface, and thickness between said lower flange lower surface and upper surface, said thickness increasing in a rearward direction.

15. The combination of claim 14 wherein said lower flange has rearward length along said lower surface thereof that is substantially greater than the lower flange maximum thickness between said lower and upper surfaces thereof.

16. The combination of claim 14 wherein said lower flange thickness increases substantially uniformly in said rearward direction, from a location proximate said front wall to the rearwardmost extent of said lower flange.

17. The combination of claim 16 wherein said lower flange at said location proximate said front wall defines a lower web.

18. The combination of claim 1 wherein said head defines a third flange integral with said upper and lower flanges, and projecting rearwardly proximate said toe, said upper and lower flanges and said third flange having thicknesses which increase in a rearward direction.

19. The combination of claim 18 wherein said head defines an additional surface facing said recess and projecting rearwardly at the heel end of said recess, said additional surface merging with said upper flange lower surface and with said lower flange upper surface.

20. The combination of claim 1 including a downwardly projecting ridge on the lower flange, said ridge extending rearwardly.

21. A golf club head having a heel, toe, upper flange, lower flange, and a front wall defining an upwardly and rearwardly inclined front face, comprising a) the head defining a forwardly extending main recess located rearwardly of said front wall, and between said upper and lower flanges, b) said upper flange having a lower surface exposed to said recess, c) said lower flange having an upper surface exposed to said recess, d) said lower and upper surfaces relatively diverging, forwardly, from generally their rearwardmost extents, and toward portions of said flanges, at least one of which has reduced thickness proximate said front wall, e) and including a downwardly projecting ridge on the lower flange, said ridge extending rearwardly.

22. A golf club head having a heel, toe, upper flange, lower flange, and a front wall defining an upwardly and rearwardly inclined front face, comprising a) the head defining a forwardly extending main recess located rearwardly of said front wall, and between said upper and lower flanges, b) said upper flange having a lower surface exposed to said recess, c) said lower flange having an upper surface exposed to said recess, d) said lower and upper surfaces relatively diverging, forwardly, from generally their rearwardmost extents, and toward portions of said flanges, at least one of which has reduced thickness proximate said front wall, e) said head defining a unitary body.

23. A golf club head having a heel, toe, upper flange, lower flange, and a front wall defining an upwardly and rearwardly inclined front face, comprising a) the head defining a forwardly extending main recess located rearwardly of said front wall, and between said upper and lower flanges, b) said upper flange having a lower surface exposed to said recess, c) said lower flange having an upper surface exposed to said recess, d) said lower and upper surfaces relatively diverging, forwardly, from generally their rearwardmost extents, and toward reduced thickness portions of said flanges, at least one of which has reduced thickness proximate said front wall, e) said head being free of backing material overlying the main extent of the rear side of said front wall and everywhere spaced from said reduced thickness portion of said one flange.

* * * * *